US009679712B2

(12) United States Patent
Nohra et al.

(10) Patent No.: US 9,679,712 B2
(45) Date of Patent: Jun. 13, 2017

(54) SWITCH ASSEMBLY AND METHOD OF USING SAME

(71) Applicant: Delta Systems, Inc., Streetsboro, OH (US)

(72) Inventors: Tanios Elias Nohra, Broadview Heights, OH (US); Isaac D. Kirbawy, Tallmadge, OH (US)

(73) Assignee: Delta Systems, Inc., Streetsboro, OH (US)

( * ) Notice: Subject to any disclaimer, the term of this patent is extended or adjusted under 35 U.S.C. 154(b) by 172 days.

(21) Appl. No.: 14/054,968

(22) Filed: Oct. 16, 2013

(65) Prior Publication Data

US 2014/0104796 A1 Apr. 17, 2014

Related U.S. Application Data

(60) Provisional application No. 61/714,420, filed on Oct. 16, 2012.

(51) Int. Cl.

| | |
|---|---|
| ***H01H 9/54*** | (2006.01) |
| ***H01H 13/12*** | (2006.01) |
| ***G08C 23/04*** | (2006.01) |
| *H01H 13/52* | (2006.01) |
| *H01H 13/18* | (2006.01) |
| *G08C 23/00* | (2006.01) |
| *H01H 13/00* | (2006.01) |
| *H01H 13/02* | (2006.01) |
| *H01H 13/14* | (2006.01) |
| *H01H 9/16* | (2006.01) |

(52) U.S. Cl.
CPC ..... *H01H 9/54* (2013.01); *G08C 23/04* (2013.01); *H01H 13/12* (2013.01); *G08C 23/00* (2013.01); *H01H 13/00* (2013.01); *H01H 13/023* (2013.01); *H01H 13/14* (2013.01); *H01H 13/183* (2013.01); *H01H 13/52* (2013.01); *H01H 2009/164* (2013.01)

(58) Field of Classification Search
CPC ..... H01H 9/54; H01H 13/00; H01H 13/14; H01H 13/183; H01H 13/023; G08C 23/04; G08C 23/00
See application file for complete search history.

(56) References Cited

U.S. PATENT DOCUMENTS 3,624,330 A 11/1971 Bognar et al.
4,502,334 A * 3/1985 Gorgens ..... G01D 5/34 250/231.19

(Continued)

*Primary Examiner* — Zachary M Pape
*Assistant Examiner* — Douglas Burtner
(74) *Attorney, Agent, or Firm* — Tarolli, Sundheim, Covell & Tummino LLP; John A. Yirga, Esq.

(57) ABSTRACT

A switch assembly and method of using same comprises a switch assembly for operating a power take off unit on a lawn tractor, the switch assembly further includes a housing supporting a selectively locatable activation knob facilitated by an actuation assembly and an internal switch arrangement coupled to a printed circuit board within the housing. The internal switch arrangement comprises a microcontroller and switch for determining the relative position of the selectively locatable activation knob and provides a digital output signal for enabling or disabling a power take off unit based on the digital output signal.

16 Claims, 5 Drawing Sheets

(56) References Cited

U.S. PATENT DOCUMENTS 4,631,940 A * 12/1986 Krivec ..... E05B 37/00 345/46
4,812,604 A 3/1989 Howard
4,839,478 A 6/1989 Howard
4,894,019 A 1/1990 Howard
4,939,328 A 7/1990 Smith
5,132,499 A 7/1992 Valenzona et al.
5,221,816 A * 6/1993 Williams ..... H01H 13/12 200/16 B
5,424,502 A 6/1995 Williams
5,495,081 A * 2/1996 Ipcinski ..... H01H 13/14 200/276.1
5,528,007 A 6/1996 Williams et al.
5,613,598 A 3/1997 Pittman et al.
5,775,482 A 7/1998 Wolfe et al.
5,947,268 A * 9/1999 Lange ..... B60Q 1/441 200/295
6,149,801 A * 11/2000 Giordano ..... B01D 17/0208 210/449
6,207,910 B1 3/2001 Harvey et al.
6,457,545 B1 10/2002 Michaud et al.
6,483,061 B1 11/2002 Harvey et al.
6,549,130 B1 * 4/2003 Joao ..... B60R 25/018 307/10.2
6,609,357 B1 8/2003 Davis et al.
6,618,022 B2 * 9/2003 Harvey ..... H01H 9/167 340/572.7
6,648,092 B2 11/2003 Michaud et al.
6,935,106 B2 8/2005 Korthals
7,034,552 B2 * 4/2006 Kirchner ..... H03K 17/962 200/600
7,034,674 B2 4/2006 Harvey
7,060,917 B1 6/2006 Park
7,064,639 B2 6/2006 Harvey et al.
7,122,817 B2 10/2006 Brill et al.
7,128,177 B2 10/2006 Harvey et al.
7,131,509 B2 11/2006 Harvey et al.
7,318,493 B2 * 1/2008 Medina ..... B60K 1/02 180/167
7,446,269 B2 * 11/2008 Stringos ..... H01H 3/166 200/16 B
7,488,914 B2 * 2/2009 Kahnert ..... H01H 13/14 200/16 B
7,629,543 B2 * 12/2009 Kahnert ..... B60K 28/10 200/17 R
7,891,448 B2 2/2011 Onderko et al.
8,027,761 B1 * 9/2011 Nelson ..... A01D 34/008 180/168
8,256,197 B2 9/2012 Kahnert
8,352,116 B2 1/2013 Boylston et al.
8,550,658 B2 * 10/2013 Hansler ..... B64F 1/20 362/231
9,053,877 B2 6/2015 Young
2002/0154860 A1 * 10/2002 Fernald ..... G01L 11/025 385/37
2004/0090127 A1 * 5/2004 Ueno ..... G06K 9/26 310/12.16
2005/0268887 A1 * 12/2005 Campbell ..... G01P 3/486 123/406.59
2006/0006861 A1 * 1/2006 Heinze ..... G01D 5/145 324/207.21
2006/0192671 A1 * 8/2006 Isenmann ..... G05B 19/042 340/531
2007/0120665 A1 * 5/2007 Martin ..... B60P 3/226 340/545.1
2007/0243830 A1 * 10/2007 Isenmann ..... H04L 12/4625 455/67.11
2008/0029376 A1 * 2/2008 Ngoagouni ..... H01H 13/20 200/345
2010/0224472 A1 * 9/2010 Horikoshi ..... H01H 13/52 200/345
2011/0043183 A1 * 2/2011 Sawada ..... G05B 9/02 323/304
2011/0248650 A1 * 10/2011 Sterling ..... B25F 5/021 315/307
2014/0104796 A1 4/2014 Nohra et al.
2014/0332357 A1 11/2014 Kirbawy

* cited by examiner

SWITCH ASSEMBLY AND METHOD OF USING SAME

CROSS REFERENCES TO RELATED APPLICATIONS

The following application claims priority to co-pending U.S. Provisional Patent Application Ser. No. 61/714,420 filed Oct. 16, 2012 entitled SWITCH ASSEMBLY AND METHOD OF USING SAME. The above-identified application is incorporated herein by reference in its entirety for all purposes.

TECHNICAL FIELD

The present disclosure relates to an electrical switch assembly, and more particularly to a switch assembly and method of using the same. In particular, the switch assembly provides a digital input/output that communicates the status and position of a PTO switch and knob with a remote control module for activating the operation of a designated device.

BACKGROUND

Electrical switches using push button or plunger type switch actuators have many applications including use in automobile car doors, ignition circuits, power take-offs for lawn mowers and garden tractors, refrigerator doors, home appliances, and the like. These push buttons may be normally open, normally closed or a combination of the two. However, such conventional switches are typically high current and conduct or transfer power to an end device for operation.

Further discussion relating to conventional switches, high current switches and their different constructions can be found in U.S. Pat. No. 5,528,007 entitled PLUNGER SWITCH AND METHOD OF MANUFACTURE that issued on Jun. 18, 1996 and assigned to the assignee of the present disclosure. U.S. Pat. No. 5,528,007 is incorporated herein by reference in its entirety by reference.

SUMMARY

One example embodiment of the present disclosure includes a switch assembly and method of using same for operating a power take off unit on a lawn tractor, the switch assembly comprises a housing supporting a selectively locatable activation knob facilitated by an actuation assembly and an internal switch arrangement coupled to a printed circuit board within the housing. The internal switch arrangement comprises a microcontroller and switch, such as an optical or infrared switch for determining the relative position of the selectively locatable activation knob and provides a digital output signal for enabling or disabling a power take off unit.

In another example embodiment of the present disclosure, the internal switch arrangement additionally comprises a plurality of switches for determining the multiple positions of the activation knob and status of the power take off unit.

While in another example embodiment, the internal switch arrangement additionally comprises a plurality of switches, including any combination of magnetic, capacitive, inductive, and mechanical switches.

Another example embodiment of the present disclosure includes a switch assembly for operating a device or performing a safety function on a lawn tractor. The switch assembly comprises a housing supporting a selectively locatable activation knob facilitated by an actuation assembly, the actuation assembly including: a support; a vane coupled to the support; at least one spring configured to bias the support to position the vane; and at least one non-contact sensor. The switch assembly also includes an internal switch arrangement coupled to a printed circuit board within the housing, the internal switch arrangement having a microcontroller, a switch in communication with the microcontroller, the switch configured to determine the relative position of the selectively locatable activation knob and providing a digital output signal for enabling or disabling operation of a lawn tractor device or lawn tractor safety function. The switch assembly further comprises a control module for receiving the digital output signal, the control module configured to decode the digital output signal to activate or deactivate the lawn tractor device or safety function, wherein the internal switch arrangement is configured to communicate with the at least one sensor of the actuation assembly, the internal switch mechanism being configured to determine the presence of the vane relative to the at least one sensor, and further wherein the actuation assembly is configured to position the knob such that the switch arrangement detects the position of the knob and forms the corresponding digital output.

Another example embodiment of the present disclosure includes a method for operating a device or performing a safety function on a lawn tractor, comprising the steps of: providing a switch assembly that includes a housing supporting a selectively locatable activation knob facilitated by an actuation assembly, an internal switch arrangement coupled to a printed circuit board within the housing, the internal switch arrangement comprising a microcontroller and switch, and a control module configured to cooperate with the internal switch mechanism. The method further comprises the steps of positioning the selectively locatable activation knob into or out of the housing; determining the relative position of the selectively locatable activation knob using the internal switch mechanism; providing a digital output signal based on the relative position of the selectively locatable activation knob; receiving the digital output signal using the control module; decoding the digital output signal; and activating or deactivating the lawn tractor device or safety function based on the digital output signal.

Another example embodiment of the present disclosure includes a switch assembly for operating a device or performing a safety function for power equipment, the switch assembly comprising: a housing supporting a selectively locatable activation knob facilitated by an actuation assembly; an internal switch arrangement coupled to a printed circuit board within the housing, the internal switch arrangement comprising a switch for determining the relative position of the selectively locatable activation knob and providing a digital output signal for enabling or disabling operation of a power equipment device or power equipment safety function, the activation knob movably connected to one of the switch arrangement and a vane and the switch.

BRIEF DESCRIPTION OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals refer to like parts unless described otherwise throughout the drawings and in which.

DETAILED DESCRIPTION

Referring now to the figures generally wherein like numbered features shown therein refer to like elements throughout unless otherwise noted. The present disclosure relates to an electrical switch assembly, and more particularly to a switch assembly and method of using the same. In particular, the switch assembly provides a digital input/output that communicates with a remote control module for activating the operation of a designated device.

Conventional power-take-off (PTO) switches used in outdoor power equipment, such as lawn garden tractors enable the operation of the blades for cutting grass or weeds. Traditionally, for lawn garden tractors, activation of the PTO involves changing the state of a high current electrical load in a high current switch that powers an electric clutch on and off. An example of a high current plunger switch is further described in U.S. Pat. No. 5,528,007 entitled PLUNGER SWITCH AND METHOD OF MANUFACTURE, which is incorporated herein by reference in its entirety by reference. In conventional high current switches, the load typically carries between three (3) and six (6) amps.

Figure 1:
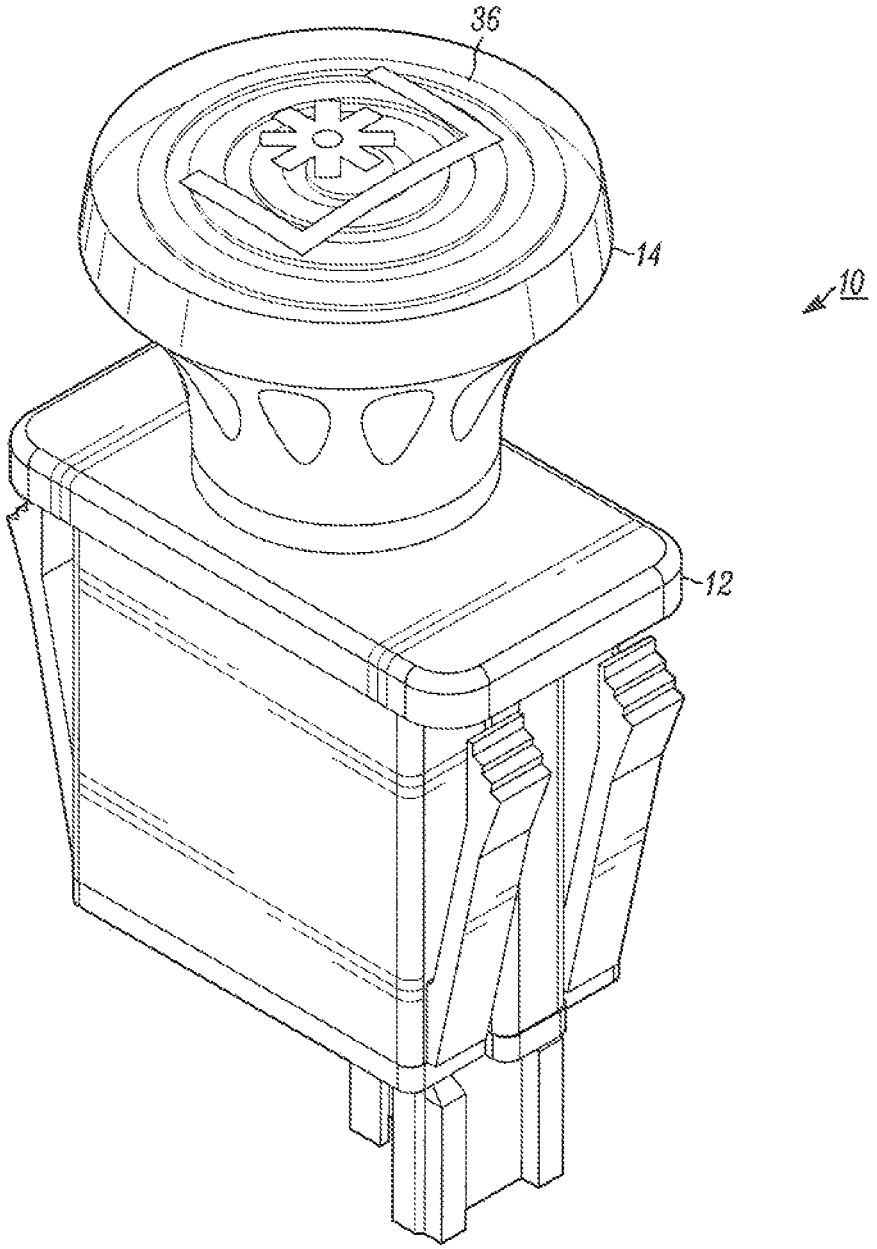
FIG. 1 is perspective view of a switch assembly constructed in accordance with one example embodiment of the present disclosure.

Referring now to FIG. 1 is a switch assembly 10 constructed in accordance with one example embodiment of the present disclosure. The switch assembly of the subject disclosure employs the novel and advantageous use of low current digital signals in the range of 10-60 mA to communicate to a remote device that performs the switching. The switch assembly 10 of the present disclosure is not switching high current, but instead employs a method of detecting switch position in the switch assembly, which is conducive to low current applications.

The switch assembly 10 while described as being used in the operation of a lawn tractor, could also be used in other forms of power equipment without departing from the spirit and scope of the present disclosure. Suitable examples of power equipment include, but is not limited to lawn tractors, push mowers, all terrain vehicles, marine vehicles, golf carts, and the like.

Figure 3:
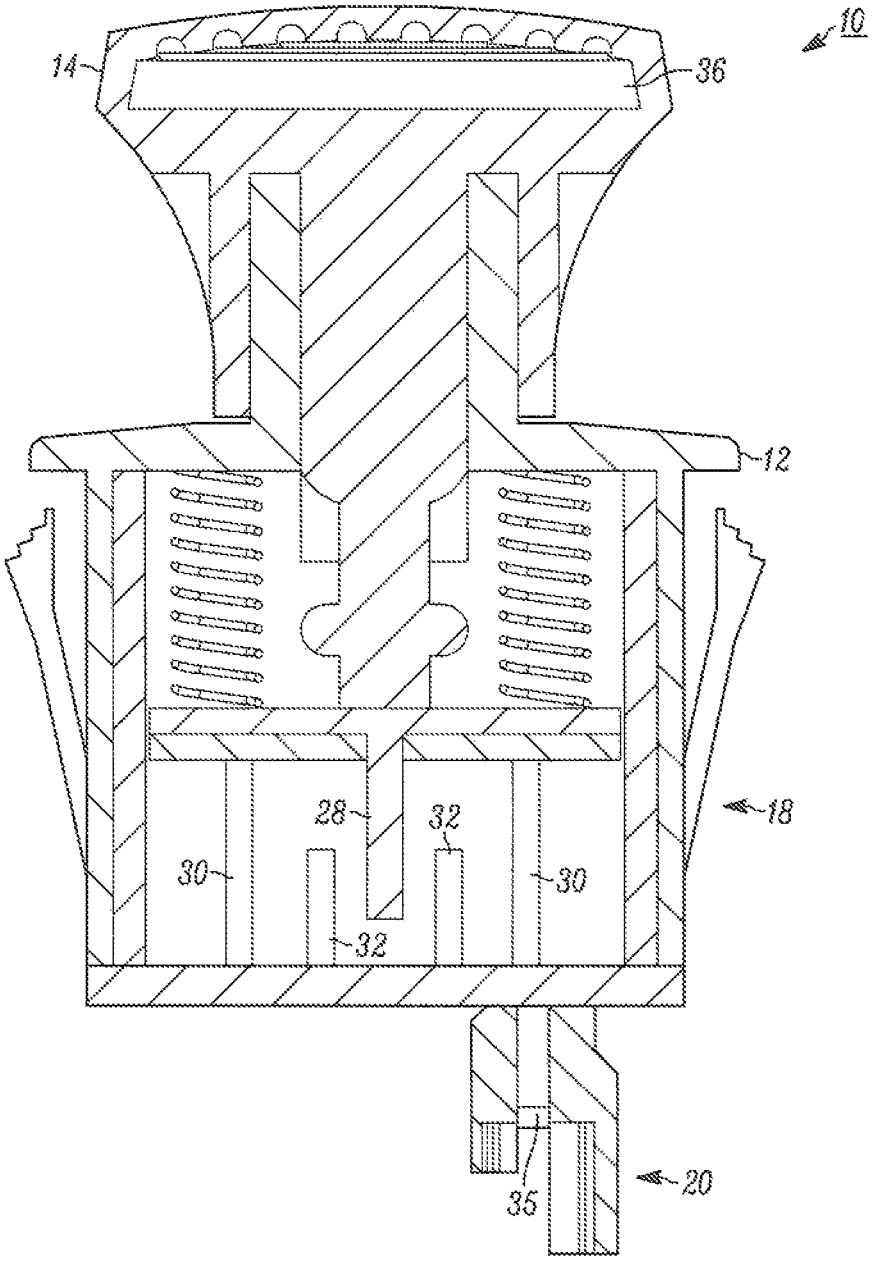
FIG. 3 is a partial sectional view of FIG. 1 illustrating the switch assembly in a second actuated position.
Figure 4:
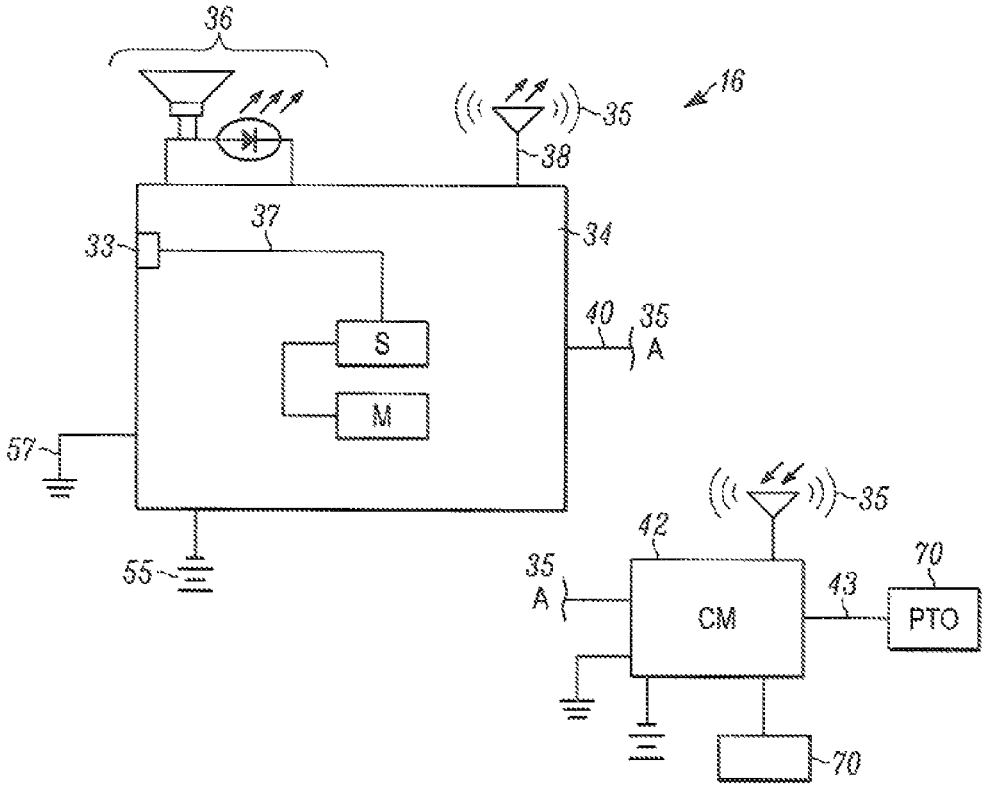
FIG. 4 a block diagram of a system associated with the switch assembly and remote control module for activating operation of a device.

The switch assembly 10 comprises a housing 12, activation knob 14, switch arrangement 16 (see FIG. 4), actuation assembly 18 (see FIGS. 3, 4), communication link 20, and control module 42. The knob 14 is actuated by the operator from a first or up position seen in FIG. 2 to a second or down position seen in FIG. 3. The up and down movement of the knob 14 is facilitated by the actuation assembly 18 internal to the housing 12. The actuation assembly 18 comprises a series of springs 22 biasing a support 24 coupled to a vane 26, which in one embodiment includes a line of sight 28. The line of sight 28 allows for the passage of light in one or more positions of the knob 14, while using an infra-red transmitters/receivers 30. In the illustrated example embodiment, the vane 26 is made from plastic and/or opaque material and the line of sight 28 is an aperture and/or made of translucent material.

Figure 2:
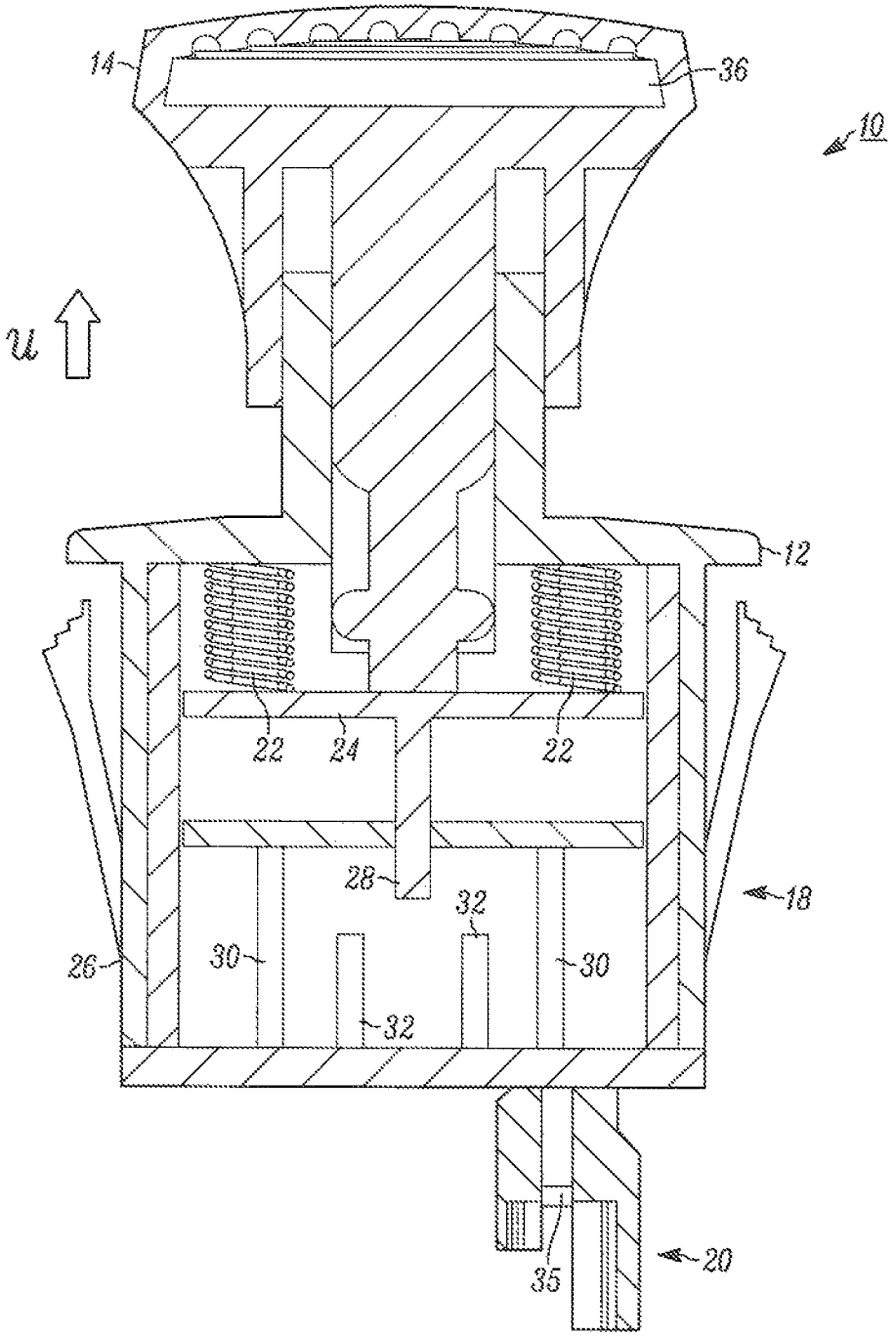
FIG. 2 is a sectional view of FIG. 1 illustrating the switch assembly in a first actuated position.

In the illustrated example embodiment results in the springs 22 provide a biasing of the vane 26 in an upward direction, (see arrow U in FIG. 2). It should be appreciated that the springs could be equally constructed to bias the movement of the vane 26 downward, opposite the direction of arrow U without departing from the spirit and scope of the present disclosure. In an alternative example embodiment, the springs 22 could move the transmitters/receivers 30 while the vane 26 remains stationary.

Figure 5:
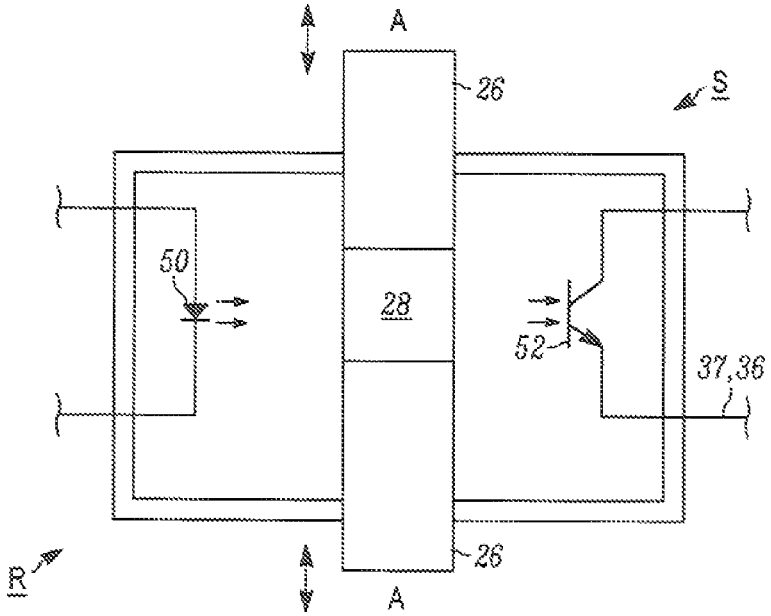
FIG. 5 is a switch used within the switch assembly constructed in accordance with one example embodiment of the present disclosure.
Figure 5A:
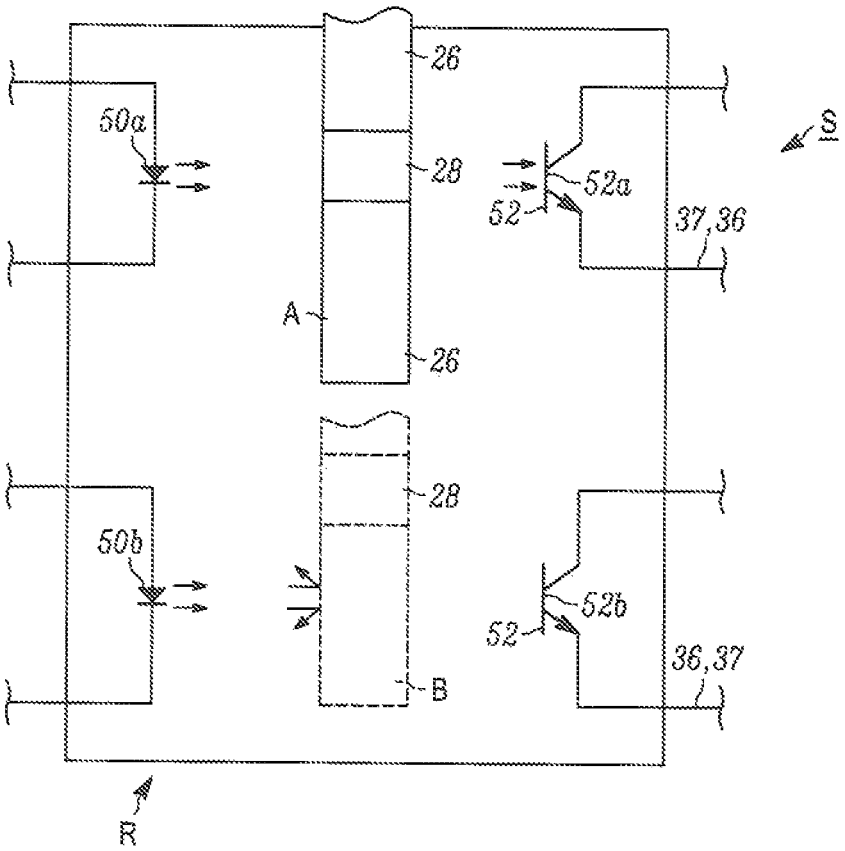
FIG. 5A is a switch used within the switch assembly having multiple sensors constructed in accordance with another example embodiment of the present disclosure.
Figure 5B:
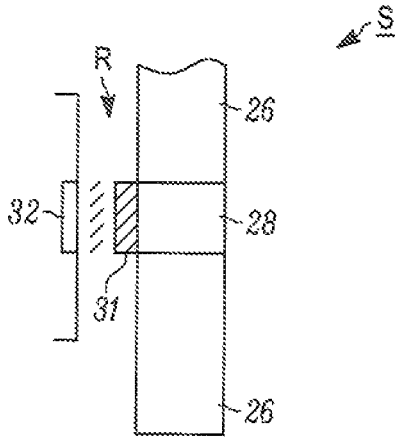
FIG. 5B is a switch used within the switch assembly having differing types of sensors constructed in accordance with another example embodiment of the present disclosure.

In an alternative example embodiments used for detecting the switch/knob 14 and more specifically the vane's position, the vane 26 is metal or magnetic such that the relative position of the knob 14 can be detected by various types of sensors R that include hall effect methods/sensors, capacitive sensors, inductive sensors, variable resistance elements, such as a potentiometer, mechanical contacts, and the like, collectively 31, as best seen in FIG. 5B. The sensors or switches R (FIG. 5A, 31 (FIG. 5B), 32 (FIGS. 2 and 3) provide the position signal 37 to the PCB 34.

Internal to the housing 12 and part of the switch arrangement 16 is a printed circuit board (PCB) 34 that provides for switch assembly 10 and discrete knob 14 position detection and forms a digital output 35 based on the relative positions of the vane 26 and aperture 28. The PCB 34 also provides some additional opportunities for features such as user indicators 36, illustrating to the operator the relative position of the knob and activation of devices 70 such as the PTO. In one example embodiment, the user indicator 36 is a light or LED located at the top of the knob 14. In an alternative example embodiment, the user indicator 36 is an audible device or combination of multiple illumination and audible devices.

In the illustrated example embodiment, the PCB 34 includes a power supply 55, such as battery power and ground 57, and input/output terminals e.g. 33, 35, 36, and 38. The power supply 55 powers all features and functions of the switch arrangement 16. The digital input/output 35 is provided on the third I/O terminal of the communication link 20. The communication link 20 in the illustrated example embodiment is a pin connection for a wiring harness.

An input 33 provides a position signal 37 from internal switch S configuration that is coupled to, and in communication with PCB 34. FIG. 5 illustrates an infra-red switch S configuration comprising emitters 50 and collectors 52 (collectively sensors R) that provide either a high or low position signals depending on the discrete location of the vane 26/switch as is moves in the directions of arrow A when the knob 14 is actuated by the operators. The high or low signal results in the position signal 37 that is transmitted via output 35 to a control module 42. Stated another way, when the switch knob 14 moves in up or down direction, one or more IR channels (TX-RX) becomes blocked or unblocked depending on the aperture 28, the intended function, and the position of the knob, thus affecting the value of the position signal 37.

The PCB 34 provides the digital output signal 35 that indicates the relative position of the knob 14/switch assembly 10, which communicates its value to a control module 42. The digital output 35 occurs either wirelessly via antenna 38 or through a direct line 40 to a corresponding input on the control module 42. In the illustrated example embodiment, the control module 42 includes firmware, software, or some form of computer readable media capable of providing instructions for operation to one or more devices 70, such as a PTO, based on the output signal 35. It should be appreciated by those skilled in the art that such switch assembly 10 could be used in any number of safety applications and types of switches without departing from the spirit and scope of the present disclosure.

The control module 42 once receiving the digital output signal 35 communicates an enablement or disablement signal 43 to a device or safety function 70 on the lawn equipment that includes a higher power requirement of 3 to 6 amps, for example turning on or off a power-take-off (PTO) or engine. For example, the signal 43 based on the switch 14 position may disengage a PTO or turn on the engine depending on the software programming of the PCB 34 and various combinations that exist.

In the illustrated example embodiment of FIGS. 2-5, a switch assembly 10 is shown. The switch assembly 10 includes a three-pin integral connector 20; a circuit board 34 that supports a microcontroller M that provides the digital output signal 35 based on the position signal 37 generated by the switch S. The microcontroller M is in communication with the switch S. In the illustrated example embodiment of FIG. 5, switch S includes an infrared transmitter/receiver pair 50/52 that detects switch 10/knob 14 position, and provides an output for an LED 36 and position signal 37. The two springs 22 bias the switch vane into the down or second position.

In an alternative example embodiment illustrated in FIG. 5A, the multiple sensors R are used that include infrared transmitter/receiver pairs 50/52*a* and 50/52*b*. The sensors R transmit the location of the switch 14 based on the location of the vane 26 and/or aperture 28 and the passage of light therethrough, as would be appreciated when looking at various positions A and B of the vane an aperture. As the switch 14 is further depressed, it moves from position A to B, thus blocking the signal at B (shown) until the aperture 28 is centered about sensors 50*b*, 52*b*.

The microcontroller M includes firmware, software, or some form of computer readable media capable of reading the position signal 37 and providing the digital output 35 based thereon. While in an alternative example embodiment, the micro controller is replaced with an application specific analog circuit or discrete circuitry. The switch assembly 10 includes a contact-less switch that provides a digital output signal for the operation of a device 70 (or the non-operation of a device as safety function/operation, e.g. turning on a blade, PTO, or engine) through a remote control module 42. Based on its intended function, the switch assembly may include one or multiple IR channels (TX-RX), a single channel being illustrated in FIG. 5. The infrared channel(s) are controlled by the onboard microcontroller M to detect blocked or unblocked channel and determine the position of the knob 14.

In one example embodiment, the switch assembly 10 reports the status and position of the switch 10/knob 14 via a serial communication link. In another alternative example embodiment, the switch assembly 10 is used in a master slave configuration to interface the control module 42. Advantageously, in the illustrated example embodiment, there is no exposure of external light to the infra-red switch/channels TX/RX or printed circuit board 34, since both are contained within the switch assembly housing 12.

As used herein, terms of orientation and/or direction such as upward, downward, forward, rearward, upper, lower, inward, outward, inwardly, outwardly, horizontal, horizontally, vertical, vertically, distal, proximal, axially, radially, etc., are provided for convenience purposes and relate generally to the orientation shown in the Figures and/or discussed in the Detailed Description. Such orientation/direction terms are not intended to limit the scope of the present disclosure, this application and the invention or inventions described therein, or the claims appended hereto.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. A switch assembly for operating a device or performing a safety function for power equipment, the switch assembly comprising:
   - a housing supporting a selectively locatable activation knob facilitated by an actuation assembly;
   - an internal switch arrangement coupled to a printed circuit board within said housing, the internal switch arrangement comprising a light sensing switch for determining the relative position of said selectively locatable activation knob and providing a low current digital output signal ranging from 10 mA to 60 mA for enabling or disabling operation of a power equipment device or power equipment safety function; and
   - a control module for receiving said digital output signal, the control module configured to decode said digital output signal to activate or deactivate the device or the safety function for the power equipment with a high current signal from 3 A to 6 A.

2. The switch assembly of claim 1 wherein said light sensing switch of the internal switch arrangement comprises a plurality of optical light sensors or infrared light sensors for determining multiple positions of the activation knob.

3. The switch assembly of claim 1 wherein said switch assembly is remotely located from said control module.

4. The switch assembly of claim 3 wherein said switch assembly sends and receives data from said control module according to a wire communication protocol.

5. The switch assembly of claim 4 wherein said control module sends and receives data from said internal switch assembly according to a wireless communication modules.

6. The switch assembly of claim 1 wherein said internal switch arrangement is a non-contact switch configuration.

7. A switch assembly for operating a power take off unit of a lawn tractor, the switch assembly comprising:
   - a housing supporting a selectively locatable activation knob facilitated by an actuation assembly, the actuation assembly including:
     - a support;
     - a vane coupled to the support;
     - at least one spring configured to bias the support to position the vane; and
     - at least one non-contact sensor;
   - an internal switch arrangement coupled to a printed circuit board within said housing, the internal switch arrangement including:
     - a microcontroller; and a light sensing switch in communication with the microcontroller, the switch configured to detect the relative position of said selectively locatable activation knob and providing a low digital output signal ranging from 10 mA to 60 mA for enabling or disabling operation of the power take off unit; and a control module for receiving said digital output signal, the control module configured to decode said digital output signal to activate or deactivate the power take off unit with a high current signal from 3 A to 6 A.

wherein the internal switch arrangement is configured to communicate with the at least one sensor of the actuation assembly, the light sensing switch being configured to determine the presence of the vane relative to the at least one sensor, and further wherein the actuation assembly is configured to position the knob such that the switch arrangement detects the position of the knob and forms the corresponding digital output.

8. The switch assembly of claim 7 wherein said switch assembly is remotely located from said control module.

9. The switch assembly of claim 7 wherein said switch assembly sends and receives data from said control module according to a wireless communication protocol.

10. The switch assembly of claim 7 wherein said control module sends and receives data from said internal switch assembly according to a wireless communication protocol.

11. A method for operating a device or performing a safety function on a lawn tractor, comprising the steps of:

providing a switch assembly that includes:

a housing supporting a selectively locatable activation knob facilitated by an actuation assembly;

an internal switch arrangement coupled to a printed circuit board within said housing, the internal switch arrangement comprising a light switch; and determining the relative position of said selectively locatable activation knob using the light sensing switch;

providing a low current digital output signal from 10 mA to 60 mA based on the relative position of said selectively locatable activation knob;

receiving said digital output signal using the control module;

decoding said digital output signal; and in response to the digital output signal, communication, by the control module, a high current signal from 3 A to 6 A to activate or deactivate the lawn tractor device or safety function based on the digital output signal.

12. The method of claim 11 further comprising the step of remotely locating said control module from said internal switch arrangement.

13. The method of claim 11 further comprising the step of using a wireless communication protocol for sending and receiving data from said internal switch assembly.

14. The method of claim 11 further comprising the step of using a wireless communication protocol for sending and receiving data from said control module.

15. A switch assembly for operating a device or performing a safety function for power equipment, the switch assembly comprising:

a housing supporting a selectively locatable activation knob facilitated by an actuation assembly and sealed from external light; and an internal switch arrangement coupled to a printed circuit board within said housing, the internal switch arrangement comprising a light sensing switch for determining the relative position of said selectively locatable activation knob and providing a low current digital output signal ranging from 10 mA to 60 mA for enabling or disabling operation of a power equipment device or power equipment safety function, the activation knob movably connected to one of said switch arrangement and a vane said switch; and a control module for receiving said digital output signal, the control module configured to decode said digital output signal to activate or deactivate the device or the safety function for the power equipment with a high current signal from 3 A to 6 A.

16. The switch assembly of claim 1, wherein the light sensing switch comprises an optical light sensing switch or an infrared light sensing switch.

* * * * *